United States Patent [19]

Rehmann

[11] Patent Number: 5,040,679

[45] Date of Patent: Aug. 20, 1991

[54] TOILET ACCESSORY FOR CONCEALING TOILET ARTICLES

[76] Inventor: Mary E. Rehmann, 17401 Sharon Rd., Chesaning, Mich. 48616

[21] Appl. No.: 504,857

[22] Filed: Apr. 5, 1990

[51] Int. Cl.[5] ..... B65D 71/00; A63H 3/00

[52] U.S. Cl. ..... 206/457; 206/225; 206/389; 206/394; 211/59.1; 242/55.54; 446/73

[58] Field of Search ..... 206/225, 226, 389, 394, 206/410, 457, 458; 242/55.54, 55.42; 150/154; 211/13, 59.1; 446/72–74; D6/518–521, 523

[56] References Cited

U.S. PATENT DOCUMENTS

| | | | |
|---|---|---|---|
| D. 230,795 | 3/1974 | Birks | D6/521 |
| D. 237,232 | 10/1975 | Garrett, Jr. | D6/520 |
| D. 248,069 | 6/1978 | Robles | D6/521 |
| 1,333,118 | 3/1920 | Klinker | 446/72 |
| 1,407,165 | 2/1922 | Pajeau | 446/74 |
| 1,451,628 | 4/1923 | Nakian | 446/72 |
| 1,544,267 | 6/1925 | Munson | 446/73 X |
| 1,636,301 | 7/1927 | Goldsmith | 446/73 |
| 1,640,260 | 8/1927 | Vogel | 446/268 |
| 2,129,654 | 9/1938 | Dennis | 446/74 X |
| 2,288,113 | 6/1942 | Smirnoff | 446/72 X |
| 2,527,007 | 10/1950 | Golino | 206/457 |
| 3,622,010 | 11/1971 | Renelt | 242/55.54 X |
| 3,704,776 | 12/1972 | Collins | 206/389 |
| 4,432,451 | 2/1984 | Hooser | 206/225 X |
| 4,607,674 | 8/1986 | Noble | 206/389 |
| 4,782,950 | 11/1988 | Sartoro | 206/457 |
| 4,820,234 | 4/1989 | Isaf | 446/321 |

FOREIGN PATENT DOCUMENTS

| | | | |
|---|---|---|---|
| 117142 | 9/1946 | Sweden | 446/73 |

*Primary Examiner*—Bryon P. Gehman
*Attorney, Agent, or Firm*—John J. Swartz

[57] ABSTRACT

A toilet accessory having the outward appearance of a doll for concealing toilet paper rolls and/or toilet plunger. The device includes a decorative figure including a doll body having an aperture in the lower end thereof for receiving an upstanding rod mounted on a base. The rod may suitably comprise the handle of a plunger. The rod may mount one or more toilet paper rolls. The apparatus includes a skirt mounted on the body and depending therefrom to surround the rod and any toilet rolls mounted thereon.

6 Claims, 1 Drawing Sheet

TOILET ACCESSORY FOR CONCEALING TOILET ARTICLES

BACKGROUND OF THE INVENTION

1. Field of the Invention

This invention relates to a toilet accessory and more particularly to cover apparatus, having the outward appearance of a doll, for concealing articles.

2. Description of the Prior Art

It is desirable, if not necessary, that extra toilet papers rolls and/or suction type toilet bowl plungers be stored and made available immediately adjacent to a residential toilet commode. Unfortunately, however, these items are sometimes considered unslightly and it is desirable to conceal these items while having them remain readily adjacent to a bathroom commode. It is an object of the present invention to provide a new and novel toilet accessory for concealing toilet articles such as toilet paper rolls and/or a toilet bowl plunger.

Bathrooms and toilets frequently have limited storage space. Accordingly, it is an object of the present invention to provide new and novel apparatus for concealing toilet articles such as toilet paper rolls and a commode plunger in a limited space.

One such attempt at disguising bathroom tissue rolls and plungers is disclosed in U.S. Pat. No. 4,432,451 issued to Oneida O. Hooser, on Feb. 21, 1984. The prior art device comprises a plunger enveloping, upstanding hollow cannister which is not particularly attractive or decorative and substantially different in construction. Accordingly, it is an object of the present invention to provide a new and novel attractive and readily useable decorative figure bathroom accessory for concealing articles such as the toilet paper and/or a plunger.

It is another object of the present invention to provide a toilet accessory which includes a decorative figure, such as a doll having a skirt depending therefrom for covering toilet articles such as toilet paper rolls and a toilet plunger.

A further object of the present invention is to provide a toilet accessory which includes a decorative figure, such as a doll having a body portion which can be removably mounted on a pedestal and a cover sheet detachably mounted on the body for covering the pedestal.

Another object of the present invention is to provide a toilet accessory of the type described wherein the pedestal includes a base mounting an upstanding rod which detachably receives toilet paper rolls and on which a decorative doll body is mounted.

A still further object of the present invention is to provide a toilet accessory of the type described wherein the pedestal comprises a toilet bowl plunger.

Other objects and advantages of the present invention will become apparent to those of ordinary skill in the art as the description thereof proceeds.

SUMMARY OF THE INVENTION

A toilet accessory for covering a toilet paper roll ~~comprising: a base member, an upstanding~~ rod mounted on the base member for releasably receiving a toilet roll; a decorative figure mounted on the rod including a body portion, a recess provided in the body portion for releasably receiving the upstanding rod and a cover skirt, mounted on and depending from the body portion, for annularly extending around the upstanding rod and the toilet roll.

BRIEF DESCRIPTION OF THE DRAWINGS

The invention may be more readily understood by referring to the accompanying drawings, in which.

DESCRIPTION OF THE PREFERRED EMBODIMENT

Figure 1:
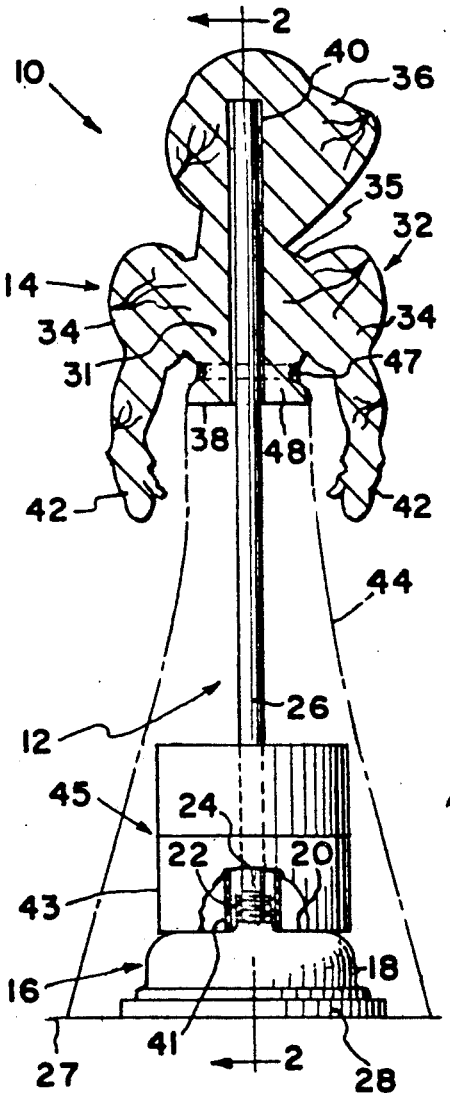
FIG. 1 is a front sectional view of a toilet accessory constructed according to the present invention, taken along the line 1—1 of FIG. 2.

The toilet accessory constructed according to the present invention, generally designated 10, includes a pedestal, generally designated 12, and a decorative doll, generally designated 14.

The pedestal 12 comprises a commode plunger including an inverted downwardly opening suction cup 16 comprising resilient, flexible material such as rubber. The cup 16 includes an annular side wall 18 and an integral top wall 20 which is vertically moveable, relative to the side wall 18, between the raised position, illustrated in solid lines in FIG. 1, and a lowered plunging position, illustrated in chain lines in FIG. 1. The top wall 20 includes a threaded nipple 22 which threadedly receives the lower threaded end 24 of an upstanding handle or plunger rod 26. For sanitation purposes, the suction cup 16 may be supported by a flat plate, generally designed 28, which is placed on a floor 27.

The doll 14 comprises a decorative figure including a generally planar panel 30 cut to provide a decorative figure having a body, generally designated 32, including a trunk portion 31, a pair of arms 34 extending laterally outwardly, downwardly therefrom, and a reduced width neck 35 mounted atop the body trunk portion 31. The doll 14 includes a head 36, which has an increased width relative to the neck 35, mounted atop the neck 35. The panel 30 may suitably comprise plastic or wood.

The body 32 includes a lower, generally flat, end wall 38 having an aperture 40 extending upwardly through the trunk 31 and neck 35 into the head 36. As illustrated, the laterally, downwardly extending arms 34 terminate in hands 42 which extend downwardly below the end wall 38. If desired, one or more toilet rolls, generally designated 45, having a hollow paper core 41 mounting rolled toilet paper 43, as usual, may be disposed on the handle rod 26 before the doll FIG. 14 is placed atop the rod 26.

The decorative doll FIG. 14 includes an annularly extending cloth or textile skirt 44 which flares radially outwardly, in a downward direction as illustrated in FIG. 1, from the body portion 32 to the level of floor 27 so as to conceal the handle 26 of cup 16 as well as the toilet rolls 45. The upper edge portion of the skirt 44 includes an annular elastic band 47 embedded therein for detachably gripping the lower end wall 38 of the doll body 32. The skirt 44 can be removed for cleaning.

~~THE OPERATION~~

The plunger 12, with or without toilet paper rolls 43 mounted on the handle 26, is stored on a floor supported plate 28. The doll 14 is mounted so that the receptacle or recess 40 receives the upper end of the plunger or rod 26, as illustrated. The skirt 44 depends downwardly from the doll body 32 to cover the rod 26, any toilet rolls 45 thereon and the suction cup 16. When it is desired to utilize the toilet rolls 45 and/or the plunger 16, the doll 14 is merely moved upwardly to a detached position in which the skirt 44 is removed from the plunger 16.

ALTERNATE EMBODIMENT

Figure 2:
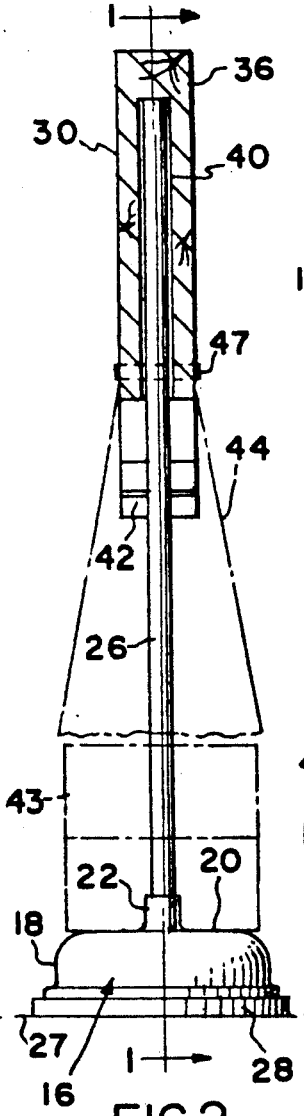
FIG. 2 is a sectional end view thereof, taken along the line 2—2 of FIG. 1.
Figure 3:
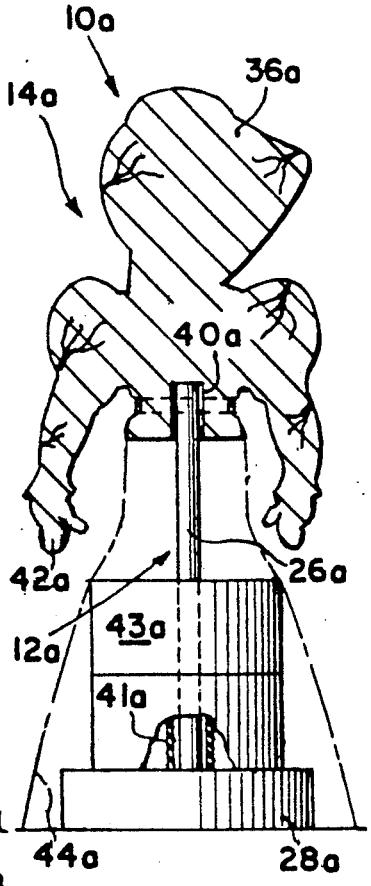
FIG. 3 is a front sectional view, similar to FIG. 1, but illustrating a slightly modified embodiment.

The embodiment illustrated in FIG. 3 is similar to the embodiment illustrated in FIGS. 1 and 2 and generally similar parts will be referred to by generally similar numerals followed by the letter a subscript.

Rather than the plunger pedestal 12, the pedestal 12*a* includes a flat disc 28*a* mounting an upstanding rod 26*a* which receives one toilet paper roll 45*a*. The remaining portion of the doll 14*a* is identical in all other respects with the exception that the skirt 44*a* is shorter than skirt 44 because the rod 26*a* is shorter than the rod 26. Rather than resting on the floor, the disc 28*a* would typically be mounted on an elevated surface such as a counter, table, or a toilet tank.

The aperture 40*a* is of substantially lesser extent, as illustrated. The hands 42*a* of the doll 14*a* are turned out slightly to avoid the skirt 44*a*.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A toil accessory for concealing a toilet roll having an aperture therethrough comprising:

a base member;

upstanding rod means mounted on said base member for detachably receiving said toilet roll;

a decorative figure mounted on said rod means including a body portion, a recess provided in said body portion for releasably freely receiving an upper portion of said upstanding rod means, and a cover skirt mounted on and freely draped from said body portion to annularly extend around said upstanding rod means and said base member;

said body portion of said decorative figure including a trunk portion, a reduced neck portion atop said trunk portion, an enlarged head portion mounted atop said neck portion, and arm portions on laterally opposite sides of said trunk portion extending downwardly to a level below the lower end of said body portion;

both of said arm portions extending the same distance below said lower end of said body portion;

said recess extending upwardly from the lower end of said trunk portion to an upper part of said head portion.

2. The toilet accessory set forth in claim 1 wherein said base member is flexible and includes an upstanding, annular side wall and a top wall integral with the upper end of said side wall; said side wall comprising yieldable material allowing said top wall to be displaced between a raised position and a lowered position; said upstanding rod means being mounted on said top wall.

3. The toilet accessory set forth in claim 2 wherein said skirt comprises textile material.

4. The toilet accessory set forth in claim 3 wherein said skirt flares outwardly downwardly from said body portion.

5. The toilet accessory set forth in claim 1 wherein said base member comprises a downwardly opening, resilient suction cup.

6. In combination:

a toilet bowl plunger including:

a flexible, inverted suction cup member, adapted to plunge a toilet bowl, including a base member and an integral annular side wall; said side wall comprising yieldable material allowing said base member to be displaced between a raised position and a lowered position; an upstanding rod being mounted to said base member for vertically moving said base member between said raised and lowered position;

a cover system for concealing said toilet bowl plunger, comprising a doll body, representing a figure, having a recess therein detachably freely receiving an upper portion of said upstanding rod; and a perimetrically extending skirt mounted on said doll body and freely depending therefrom to cover said rod and said base;

said doll body including a body trunk portion, a head portion mounted atop said trunk portion and a pair of arm portions on laterally opposite sides of said body trunk portion extending downwardly to a level below the lower end of said body trunk portion, both of said arm portions extending the same distance below the lower end of said body trunk portion.

* * * * *